US009841172B2

(12) United States Patent
Watanabe

(10) Patent No.: US 9,841,172 B2
(45) Date of Patent: Dec. 12, 2017

(54) LIGHT IRRADIATING DEVICE

(71) Applicant: HOYA CANDEO OPTRONICS CORPORATION, Toda-shi, Saitama (JP)

(72) Inventor: Hiroaki Watanabe, Toda (JP)

(73) Assignee: HOYA CANDEO OPTRONICS CORPORATION, Toda-Shi, Saitama (JP)

( * ) Notice: Subject to any disclaimer, the term of this patent is extended or adjusted under 35 U.S.C. 154(b) by 0 days.

(21) Appl. No.: 15/404,789

(22) Filed: Jan. 12, 2017

(65) Prior Publication Data

US 2017/0205062 A1 Jul. 20, 2017

(30) Foreign Application Priority Data

Jan. 15, 2016 (JP) ..... 2016-006520

(51) Int. Cl.

| | |
|---|---|
| ***F21V 23/00*** | (2015.01) |
| ***B41M 7/00*** | (2006.01) |
| ***F21V 29/80*** | (2015.01) |
| ***F21V 29/67*** | (2015.01) |
| ***F21V 29/51*** | (2015.01) |

(Continued)

(52) U.S. Cl.

CPC ..... *F21V 23/005* (2013.01); *B41M 7/0081* (2013.01); *F21V 29/51* (2015.01); *F21V 29/673* (2015.01); *F21V 29/80* (2015.01); *F21V 29/83* (2015.01); *F21Y 2115/10* (2016.08)

(58) Field of Classification Search

USPC .... 250/488.1, 492.1, 494.1, 504 R; 347/101, 347/102, 104, 108, 130, 152; 362/230, 362/294, 249.02, 249.13, 259, 275, 362, 362/373

See application file for complete search history.

(56) References Cited

U.S. PATENT DOCUMENTS

2005/0243539 A1* 11/2005 Evans ..... H01L 33/648 362/84
2006/0193139 A1 8/2006 Sun et al.
2009/0237933 A1 9/2009 Liu (Continued)

FOREIGN PATENT DOCUMENTS

JP 2007-065507 A 3/2007
JP 2012-014992 A 1/2012

(Continued)

*Primary Examiner* — Bernard Souw
(74) *Attorney, Agent, or Firm* — Rabin & Berdo, P.C.

(57) ABSTRACT

The light irradiating device which irradiates linear light includes: a substrate which is parallel to first and second directions; a plurality of LED light sources which emits light in a third direction intersecting a surface of the substrate; a heat transporting unit which extends in a direction opposite to the third direction from the substrate; a cooling unit which has a heat radiating pin radiating the heat of the heat transporting unit into the air, an LED driver circuit which drives the LED light source; a housing which has an opening sucking and exhausting external air on one surface of the second direction, accommodates the cooling unit and the LED driver circuit, and forms a wind tunnel in an area where the cooling unit and the LED driver circuit are disposed; and a fan which is provided at a side opposite to the third direction of the cooling unit.

13 Claims, 15 Drawing Sheets

(51) Int. Cl.
*F21V 29/83* (2015.01)
*F21Y 115/10* (2016.01)

(56) References Cited

U.S. PATENT DOCUMENTS

| | | | | |
|---|---|---|---|---|
| 2011/0148321 | A1* | 6/2011 | Kwon | F21V 29/004 315/294 |
| 2011/0280033 | A1* | 11/2011 | Kishimoto | F21S 48/1145 362/543 |
| 2012/0001991 | A1 | 1/2012 | Onozawa et al. | |
| 2012/0281390 | A1* | 11/2012 | Nakamura | A61B 90/35 362/103 |
| 2014/0339440 | A1* | 11/2014 | Schadt | H01L 25/0753 250/492.1 |
| 2016/0348887 | A1* | 12/2016 | Kobayashi | B41J 11/002 |

FOREIGN PATENT DOCUMENTS

| | | | |
|---|---|---|---|
| JP | 2012-028267 | A | 2/2012 |
| JP | 2013-077575 | A | 4/2013 |
| JP | 2013-171882 | A | 9/2013 |
| JP | 2013-252720 | A | 12/2013 |
| JP | 2015-125871 | A | 7/2015 |
| JP | 2015-199362 | A | 11/2015 |

* cited by examiner

LIGHT IRRADIATING DEVICE

CROSS-REFERENCE TO RELATED APPLICATIONS

This application claims priority to and the benefit of Japanese Patent Application No. 2016-006520 filed in the Japan Intellectual Property Office Jan. 15, 2016, the entire contents of which are incorporated herein by reference.

TECHNICAL FIELD

The present invention relates to a light irradiating device which includes a light emitting diode (LED) as a light source and irradiates linear light, and more particularly, to a light irradiating device which includes a heat radiating member which radiates heat generated from the LED.

BACKGROUND ART

According to the related art, a printing device which performs printing using a UV ink which is cured by irradiating an ultraviolet ray is known. In this printing device, an ink is discharged onto a medium from a nozzle of a head and then the ultraviolet ray is irradiated onto a dot formed on the medium. The dot is cured by irradiating the ultraviolet ray to be fixed onto the medium so that satisfactorily printing may be performed on a medium in which it is hard to absorb liquid. For example, the printing device is disclosed in Patent Document 1.

In Patent Document 1, disclosed is a printing device including a conveying unit which conveys a printing medium, six heads which are arranged in a conveying direction and discharge cyan, magenta, yellow, black, orange, and green inks, six temporarily curable irradiating units which are arranged in a downstream of a conveying direction between heads to temporarily cure (pinning) dot ink discharged onto the printing medium from each head, and a mainly curable irradiating unit which mainly cures the dot ink to be fixed onto the printing medium. The printing device disclosed in Patent Document 1 cures the dot ink in two steps, that is, the temporary curing step and the mainly curable step, so that bleeding between color inks or spreading of the dot is suppressed.

The temporarily curable irradiating unit disclosed in Patent Document 1 is a so-called ultraviolet irradiating device which is disposed above the printing medium to irradiate an ultraviolet ray on the printing medium and irradiates a linear ultraviolet ray in a width direction of the printing medium. In the temporarily curable irradiating unit, an LED is used as a light source in accordance with a demand for a lightweight and a compact size of the printing device. A plurality of LEDs is disposed to be parallel to each other along the width direction of the printing medium.

Related Art Document

[Patent Document]

Japanese Patent Application Laid-Open No. 2013-252720

SUMMARY OF THE INVENTION

When the LED is used as a light source like the temporarily curable irradiating unit disclosed in Patent Document 1, most of the supplied power is converted into heat so that luminous efficiency and the life span are lowered due to the heat generated from the LED. Further, in the case of a device in which a plurality of LEDs is mounted like the temporarily curable irradiating unit, since the number of LEDs which serve as a light source is increased, the above-mentioned problem may become more serious. Therefore, a light irradiating device which uses the LED as a light source, generally, is configured to suppress the heat generation of the LED using a heat radiating member such as a heat sink.

In order to suppress the heat generation of the LED, a heat radiating member such as a heat sink is effectively used. However, in order to efficiently radiate the heat of the LED, a surface area of the heat radiating member needs to be increased as much as possible. However, when the size of the heat radiating member is increased, a size of the entire apparatus is correspondingly increased. Specifically, when a large size heat radiating member is applied to the light irradiating device which is disposed between heads such as the temporarily curable irradiating unit of Patent Document 1, distances between heads are set to be large. Further, heavy-weight and a large size of the printing device are caused, so that a thin device is required.

Further, in order to emit light from the LED, a driver circuit which supplies power to the LED is necessary. However, when a plurality of LEDs emits light, like the temporarily curable irradiating unit disclosed in Patent Document 1, the driver circuit also significantly generates heat, so that not only the LEDs, but also the driver circuit needs to efficiently radiate heat.

The present invention has been made in an effort to provide a thin light irradiating device which includes a configuration to efficiently radiate heat of the LED and the driver circuit.

According to an aspect of the present invention, an light irradiating device extends on an irradiating surface in a first direction and irradiates line shaped light having a predetermined line width in a second direction intersecting the first direction. The light irradiating device includes: a substrate which is substantially parallel to the first direction and the second direction; a plurality of light emitting diode (LED) light sources which is disposed on a surface of the substrate with predetermined intervals along the first direction and emits light in a third direction intersecting the surface of the substrate; a cooling unit which includes a heat transporting unit which at least partially abuts against a rear surface of the substrate, extends in an opposite direction to the third direction from the substrate, and transports heat generated from the LED light source to the opposite direction to the third direction, and a plurality of heat radiating pins which is mounted on the heat transporting unit to radiate heat of the heat transporting unit into the air; an LED driver circuit which drives the plurality of LED light sources; a housing which has an opening sucking and exhausting an external air on one surface of the second direction, accommodates the cooling unit and the LED driver circuit, and forms a wind tunnel in an area where the cooling unit and the LED driving circuit are disposed; and a pan which is provided at a side opposite to the third direction of the cooling unit to guide the external air to a wind tunnel and generate an air current in the wind tunnel, in which the cooling unit is disposed along the one surface and the LED driver circuit is disposed along the other surface which is opposite to the one surface.

With this configuration, the LED and the driver circuit are simultaneously cooled. Further, an opening which sucks and exhausts the air is disposed on one surface in the second direction and the outside air is exhausted or sucked to a direction opposite to the third direction (that is, the air current is folded from the second direction to the third direction or from the third direction to the second direction), so that a thin housing in the second direction may be used.

The opening may be formed in an area facing the plurality of heat radiating pins in the one direction of the housing so as to expose the plurality of heat radiating pins from the opening.

The opening may be formed in a part of an area facing the plurality of heat radiating pins in the one direction of the housing so as to expose a part of the plurality of heat radiating pins at the substrate side from the opening.

The opening may be formed more downstream of the third direction than an area facing the plurality of heat radiating pins in the one direction of the housing so as not to expose the plurality of heat radiating pins from the opening.

The plurality of heat radiating pins may be a parallel flat type pin which is disposed to be substantially parallel to the substrate so that the heat transporting unit passes therethrough, a radiation type pin which radially protrudes from an outer periphery of a tubular heat radiating member into which the heat transporting unit is inserted, or a corrugated pin which is provided in the heat transporting unit. When the plurality of heat radiating pins is parallel flat type pins, the parallel flat type pin may have a plurality of through holes through which the air passes.

Further, the outside air may flow between the plurality of heat radiating pins from the opening and flow along the LED driver circuit to be exhausted from the fan.

Further, the outside air may flow from the fan to flow along the LED driver circuit and pass between the plurality of heat radiating pins to be exhausted from the opening.

The heat transporting unit may be at least one heat pipe or at least one coolant flow channel in which coolant is included. When the heat transport unit is the plurality of heat pipes, the heat pipes may be offset in the second direction with respect to a heat pipe adjacent thereto along the first direction.

When a length of the cooling unit in the second direction is L1 and a length of the heat radiating pin in the second direction is L2, the following conditional expression 1 may be satisfied.

$$L2<L1 \quad (1)$$

The light may be light in an ultraviolet wavelength band.

According to another aspect of the present invention, a light irradiating device extends on an irradiating surface in a first direction and irradiates line shaped light having a predetermined line width in a second direction intersecting the first direction. The light irradiating device includes: a substrate which is substantially parallel to the first direction and the second direction; a plurality of light emitting diode (LED) light sources which is disposed on a surface of the substrate with predetermined intervals along the first direction and emits light in a third direction intersecting the surface of the substrate; a cooling unit which includes a heat transporting unit which is at least partially in contact with a rear surface of the substrate, extends in an opposite direction to the third direction from the substrate, and transports heat generated from the LED light source to the opposite direction to the third direction, and a plurality of heat radiating pins which is mounted on the heat transporting unit to radiate heat of the heat transporting unit into the air; an LED driver circuit which drives the plurality of LED light sources; a housing which has an opening sucking and exhausting an external air on one surface of the second direction, accommodates the cooling unit and the LED driver circuit, and forms a wind tunnel in an area where the cooling unit and the LED driving circuit are disposed; and a fan which is provided between the opening and the heat radiating pin in the third direction to guide the external air to the wind tunnel and generate an air current in the wind tunnel, in which the housing has an opening which sucks or exhausts the outside air, on one surface in the second direction, the LED driver circuit is disposed along the one direction and the cooling unit is disposed along the other surface which is opposite to the one surface.

As described above, according to the present invention, a thin light irradiating device which includes a configuration to efficiently radiate heat of the LED and the driver circuit is implemented.

DETAILED DESCRIPTION

Figure 1:
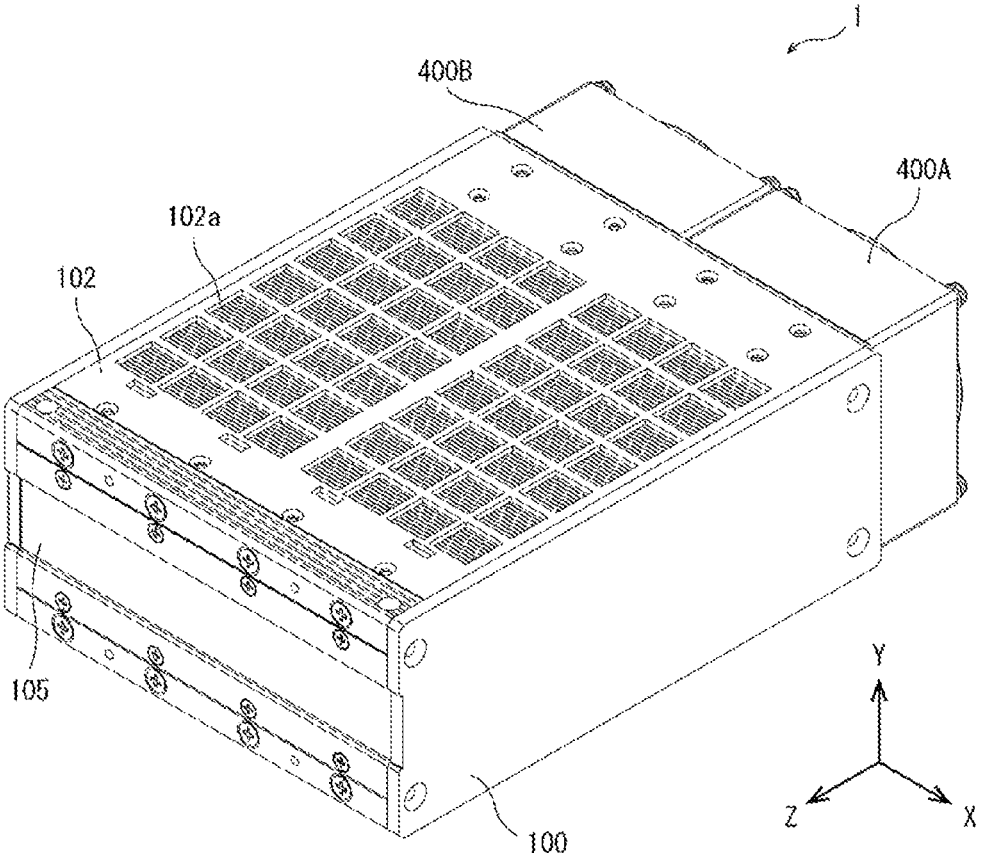
FIG. 1 is a perspective view of an exterior appearance of a light irradiating device according to a first exemplary embodiment of the present invention.

Hereinafter, exemplary embodiments of the present invention will be described in detail with reference to the drawings. Further, in the drawings, like elements are denoted by like reference numerals, and description thereof will be omitted.

First Exemplary Embodiment

Figure 2:
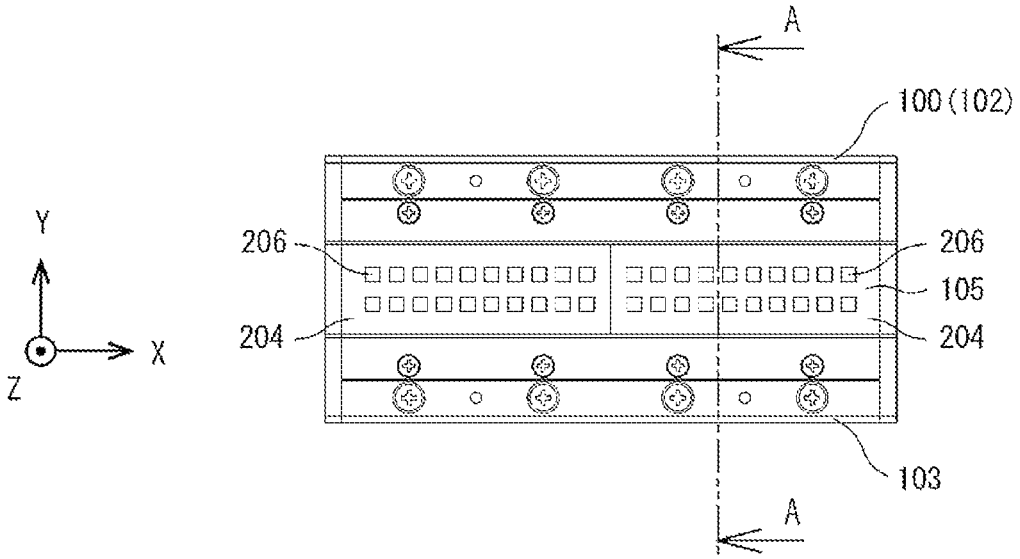
FIG. 2 is a front view of a light irradiating device according to a first exemplary embodiment of the present invention.
Figure 3:
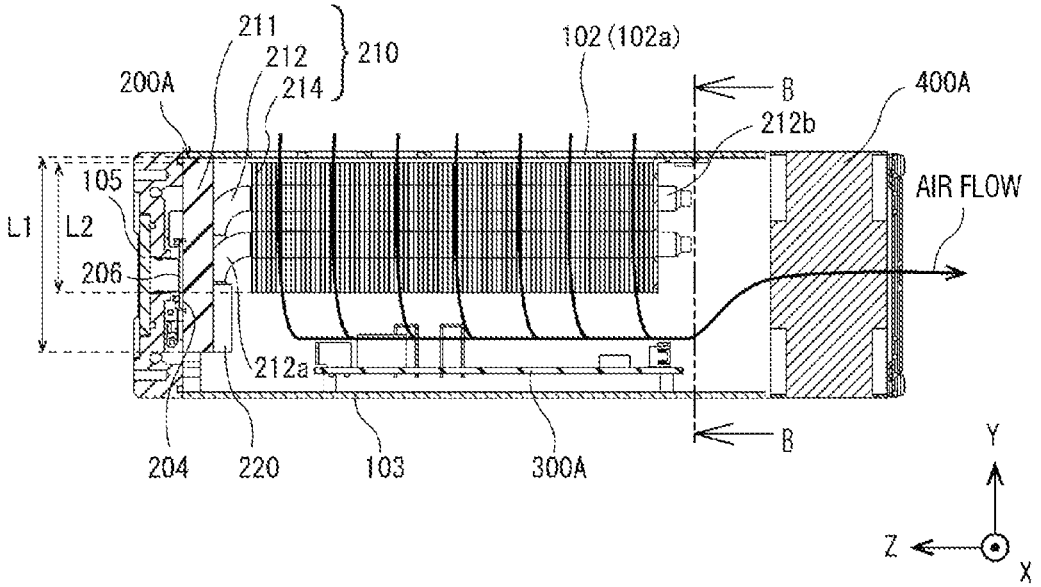
FIG. 3 is a cross-sectional view taken along line A-A of FIG. 2.
Figure 4:
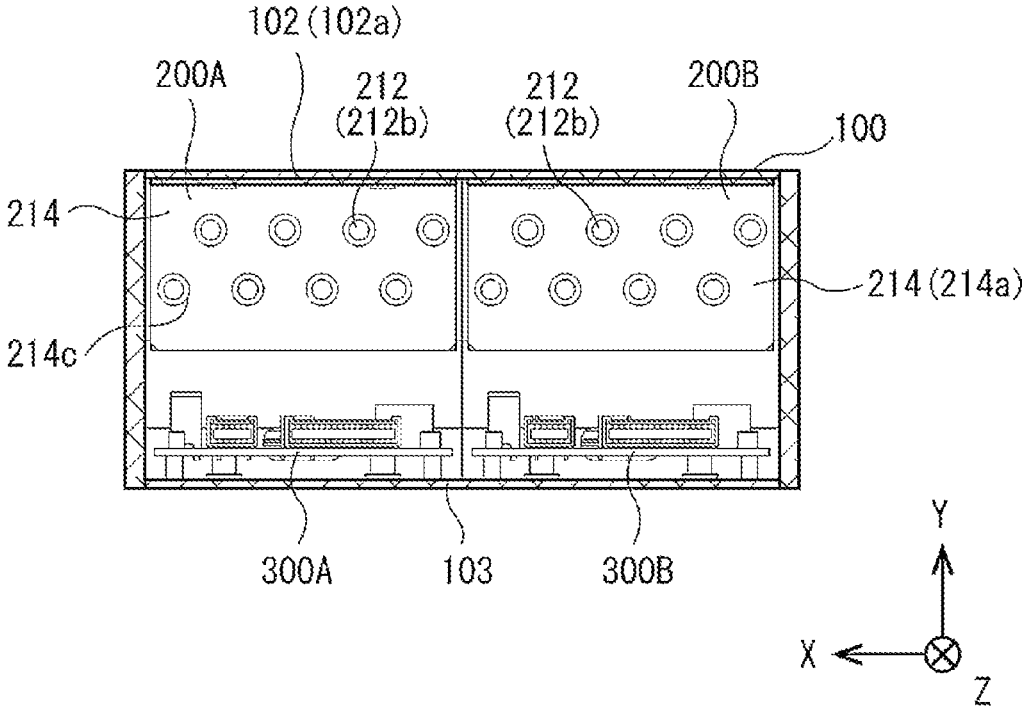
FIG. 4 is a cross-sectional view taken along the line B-B of FIG. 3.
Figure 5:
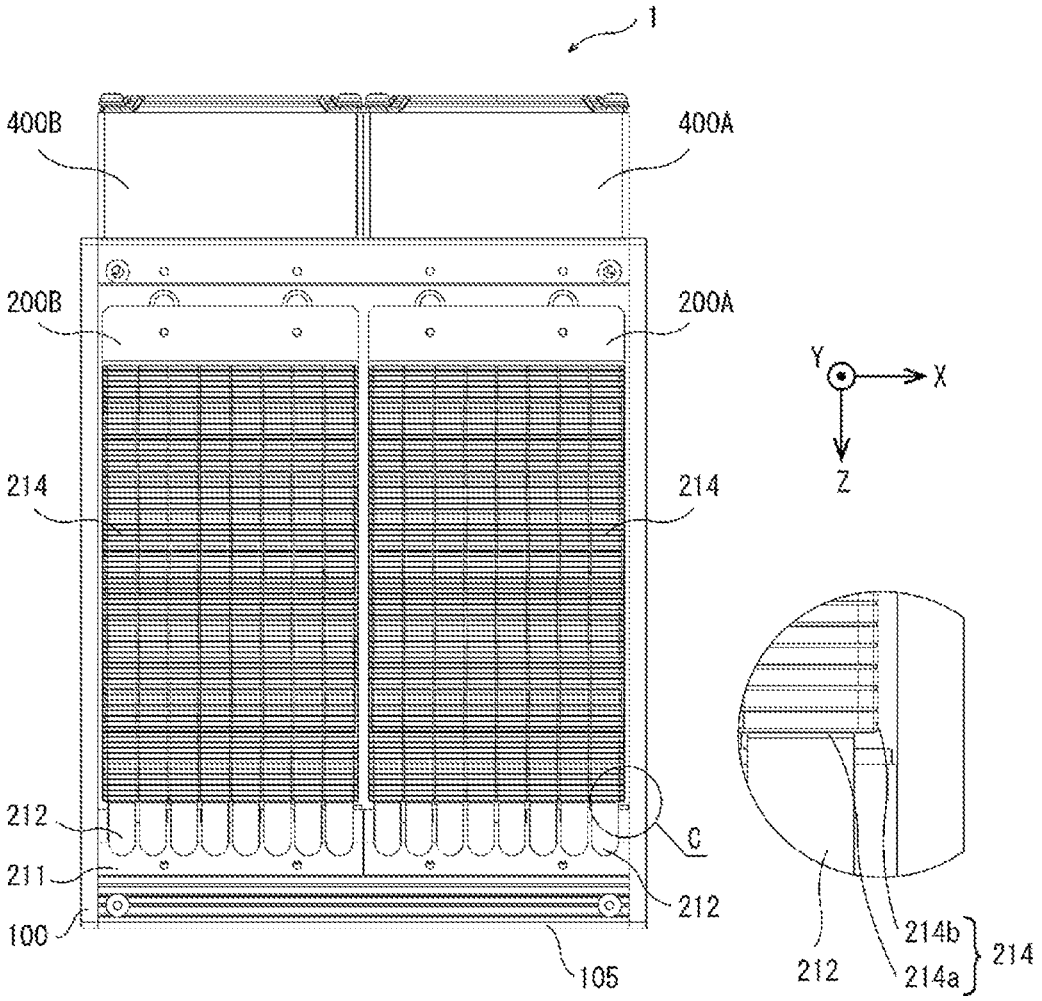
FIG. 5 is a view illustrating a shape in which an upper side panel is removed from a light irradiating device according to a first exemplary embodiment of the present invention.

FIG. 1 is a perspective view of an exterior appearance of a light irradiating device 1 according to a first exemplary embodiment of the present invention. Further, FIG. 2 is a front view of the light irradiating device 1, FIG. 3 is a cross-sectional view (a cross-sectional view of a Y-Z plane) taken along line A-A of FIG. 2, and FIG. 4 is a cross-sectional view taken along the line B-B of FIG. 3. Further, FIG. 5 is a view illustrating a shape in which an upper side panel 102 of the light irradiating device 1 is removed, and specifically, FIG. 5A is a top view and FIG. 5B is an enlarged view of a part C of FIG. 5A. The light irradiating device 1 according to this exemplary embodiment is a light source device which is mounted in a printing device to cure an ultraviolet curable ink or an ultraviolet curable resin. For example, the light irradiating device 1 is disposed above an object to be irradiated to emit a linear ultraviolet ray to the object to be irradiated. Further, in this specification, as illustrated in a coordinate of FIG. 1, a direction in which a light emitting diode (LED) element 206 which will be described below emits an ultraviolet ray is defined as a Z-axis direction, an arrangement direction of the LED elements 206 is defined as an X-axis, and a direction perpendicular to the Z-axis direction and the X-axis direction is defined as a Y-axis direction.

As illustrated in FIG. 1, the light irradiating device 1 according to the exemplary embodiment includes a thin box shaped case (housing) 100 in which light source units 200A and 200B are accommodated. The case 100 includes a window 105 formed of glass through which the ultraviolet ray is emitted, in the front side. Further, on an upper side panel 102 (one surface to which a cooling device 210 which will be described below is disposed to be close) of the case 100, a plurality of suction ports 102*a* (openings) through which air flows into the case 100 from the outside is formed and driver circuits 300A and 300B are mounted at an inner side of a lower side panel 103 (see FIGS. 3 and 4). Further, fans 400A and 400B which flow air in the case 100 from the outside, generate an air current in the case 100, and exhaust air in the case 100 are mounted on a rear surface (an end face opposite to the Z-axis direction) of the case 100.

As illustrated in FIGS. 2, 4, and 5, the light irradiating device 1 according to the exemplary embodiment includes two light source units 200A and 200B, two driver circuits 300A and 300B in the case 100. Two light source units 200A and 200B are devices having the same configuration which are arranged in the X-axis direction and the driver circuits 300A and 300B are electronic circuits which drive the light source units 200A and 200B, respectively.

As illustrated in FIGS. 2 and 3, each of the light source units 200A and 200B includes a rectangular substrate 204 which is parallel to the X-axis direction and the Y-axis direction, twenty LED elements 206 which are disposed by two columns by ten LED elements on the substrate 204, and a cooling device 210. As described above, in the exemplary embodiment, the light source unit 200A and the light source unit 200B have the same configuration, so that a configuration of the light source unit 200A will be representatively described in detail.

The twenty LED elements 206 of the light source unit 200A are disposed on a surface of the substrate 204 (see FIG. 2) while aligning an optical axis to the Z-axis direction. An anode pattern (not illustrated) and a cathode pattern (not illustrated) which supply power to each of the LED elements 206 are formed on the substrate 204. Each LED element 206 is soldered to the anode pattern and the cathode pattern to be electrically connected to each other. Further, the substrate 204 is electrically connected to the driver circuit 300A by a wiring cable which is not illustrated. Further, a driving current is supplied to each LED element 206 from the driver circuit 300A, by means of the anode pattern and the cathode pattern. When the driving current is supplied to each LED element 206, an ultraviolet ray (for example, 365 nm of a wavelength) with a light quantity in accordance with the driving current is emitted from each LED element 206 and a linear ultraviolet ray parallel to the X-axis direction is emitted from the light source unit 200A. In the exemplary embodiment, the linear ultraviolet ray from the light source unit 200A and the linear ultraviolet ray from the light source unit 200B are configured to be continuous in the X-direction. Further, a driving current which is supplied to each LED element 206 is adjusted to allow each LED element 206 of the exemplary embodiment to emit the ultraviolet ray having substantially the same light quantity. Further, the linear ultraviolet ray emitted from the light source units 200A and 200B has substantially uniform light quantity distribution in the X-axis direction.

The cooling device 210 is a member which radiates heat generated from the light source unit 200A and cools the LED element 206. As illustrated in FIGS. 1, 3, and 5, the cooling device 210 according to the exemplary embodiment is configured by a metal (for example, copper or aluminum) support plate 211 which extends in the X-axis direction in the case 100 and has a substrate 204 mounted on one end face (a surface facing a front side of the case 100), eight heat pipes 212 (heat transporting units) which have one end closely fixed to the other end (a surface opposite to a surface on which the substrate 204 is disposed) of the support plate 211 and transport heat generated in each LED element 206, and a plurality of heat radiating pins 214 which is closely fixed to each heat pipe 212. When a driving current flows in each LED element 206 and the ultraviolet ray is emitted from each LED element 206, the temperature of the LED element 206 is increased due to self-heating and the luminous efficiency is significantly lowered. Therefore, according to the exemplary embodiment of the present invention, the cooling device 210 is provided to be closely attached onto a rear surface of the substrate 204 to conduct the heat generated in the LED element 206 to the cooling device 210 by means of the substrate 204, thereby forcibly radiating the heat. Further, in the exemplary embodiment, the heat radiating pin 214 of the cooling device 210 is disposed along the upper side panel 102 of the case 100. The heat radiating pin 214 and the driver circuit 300A disposed on the lower side panel 103 are cooled by air which flows into the plurality of suction ports 102*a* from the outside (details will be described below).

The heat pipe 212 is a hollow metal sealed pipe (for example, metal such as copper, aluminum, iron, or magnesium or an alloy including the same) having a substantially circular cross-section in which an operating fluid (for example, water, alcohol, or ammonia) is sealed at a reduced pressure. As illustrated in FIG. 3, the heat pipe 212 of the exemplary embodiment has substantially an L shape as seen from the X-axis direction. The heat pipe 212 is configured by a curved part 212*a* which is closely attached onto a rear surface of the support plate 211, and an arm unit 212*b* which protrudes in a negative direction of the Z-axis direction (that is, an opposite direction to an ultraviolet ray emission direction) from the curved part 212*a*. The curved part 212*a* is fixed to the support plate 211 so as to be closely attached to another end face of the support plate 211 through the fixture 220 and is thermally coupled to the substrate 204. Each of the light source units 200A and 200B of the exemplary embodiment includes eight heat pipes 212 (see FIG. 5) which are arranged in the X-axis direction. As seen from the Z-axis direction, the arm units 212*b* of the eight heat pipes 212 are offset to be divided into two upper and lower stages to be alternately disposed (see FIG. 4). The arm units 212*b* are configured to form a gap in the Y-axis direction between the arm units 212*b* of the heat pipe 212 which is adjacent thereto in the X-axis direction (that is, disposed to form a zigzag pattern). As described above, according to the exemplary embodiment, between the arm units 212*b* of the heat pipe 212, gaps in the X-axis direction and the Y-axis direction are provided so that the air may easily flow between the arm units 212*b* of the heat pipes 212 (details will be described below).

The heat radiating pin 214 is a rectangular metal (for example, metal such as copper, aluminum, iron, or magnesium or an alloy including the same) member. As illustrated in FIGS. 3 to 5, eight through holes 214*c* through which arm units 212*b* of the heat pipes 212 are inserted are formed in each heat radiating pin 214 of the exemplary embodiment. In the exemplary embodiment, the arm units 212*b* of the heat pipes 212 are sequentially inserted into 70 sheets of heat radiating pins 214 and the heat radiating pins 214 are disposed with a predetermined interval along the Z-axis direction (that is, parallel to the substrate 204) (see FIGS. 3 and 5). Further, each heat radiating pin 214 is mechanically and thermally coupled to each arm unit 212*b* by welding, soldering, or pressing, in each through hole 214*c*. Further, as illustrated in FIG. 5B, the heat radiating pin 214 of the exemplary embodiment is configured by a flat part 214*a* which is parallel to the X-axis direction and the Y-axis direction as seen from the Y-axis direction and a folded part 214*b* which is folded to the negative direction of the Z-axis direction at both ends of the X-axis direction of the flat part 214*a*. The folded part 214*b* is configured to be in contact with the flat part 214*a* of the heat radiating pin 214 which is adjacent thereto. The outside air which flows into the light source unit 200A and the light source unit 200B does not interfere in the X-axis direction (that is, is not leaked to the X-axis direction) by providing the folded part 214*b*, so that the light source unit 200A and the light source unit 200B may be closely disposed. In other words, even though the light source unit 200A and the light source unit 200B are closely disposed, the air which is sucked by the light source unit 200A and the air which is sucked by the light source unit 200B do not interfere with each other.

Further, as illustrated in FIG. 3, a length L2 of the heat radiating pin 214 of the exemplary embodiment in the Y-axis direction is set to be smaller than a length L1 of the support plate 211 in the Y-axis direction (that is, a relationship of L2<L1 is satisfied) and the driver circuit 300A is disposed at a lower side (a side opposite to the Y-axis direction in FIG. 3) than the cooling device 210.

When a driving current flows in each LED element 206 and the ultraviolet ray is emitted from each LED element 206, the temperature of the LED element 206 is increased due to self-heating. But the heat generated in each LED element 206 is quickly conducted (moves) to the folded part 212*a* of the heat pipe 212 by means of the substrate 204 and the support plate 211. When the heat moves to the folded part 212*a* of the heat pipe 212, the operating fluid in the heat pipe 212 absorbs the heat to be evaporated and steam of the operating fluid moves through a hollow part in the arm unit 212*b*, so that the heat of the folded part 212*a* moves to the arm unit 212*b*. Further, the heat which moves to the arm unit 212*b* moves to the plurality of heat radiating pins 214 which is coupled to the arm unit 212*b* to be radiated from the heat radiating pin 214 into the air. When the heat is radiated from the heat radiating pin 214, the temperature of the arm unit 212*b* is correspondingly lowered. Therefore, the steam of the operating fluid in the arm unit 212*b* is cooled to return to a liquid state and move to the folded part 212*a*. The operating fluid which moves to the folded part 212*a* is used to absorb heat which is newly conducted by means of the substrate 204 and the support plate 211.

As described above, in the exemplary embodiment, the operating fluid in the heat pipe 212 circulates between the folded part 212*a* and the arm unit 212*b* to quickly move the heat generated in each LED element 206 to the heat radiating pin 214 and efficiently radiate the heat from the heat radiating pin 214 into the air. By doing this, the temperature of the LED element 206 is not excessively increased and the luminous efficiency is not significantly lowered.

The fans 400A and 400B are devices which flow the air into the light source units 200A and 200B from the outside and generate air current in the case 100, and exhaust the air in the case 100 to the outside. As illustrated in FIGS. 1 and 3, in the exemplary embodiment, a plurality of suction ports 102*a* is formed in an area facing the heat radiating pin 214 of the upper side panel 102 to expose the heat radiating pin 214 from the suction port 102*a*. Further, as illustrated by an arrow (an air flow) in FIG. 3, when the fans 400A and 400B rotate, the outside air is flowed through the plurality of suction ports 102*a* and passes between the heat radiating pins 214 of the light source unit 200A and the light source unit 200B, so that the heat of the heat radiating pin 214 is efficiently radiated to the air. Further, the air which passes between the heat radiating pins 214 touches the driver circuit 300A which is disposed at a lower side (a side opposite to the Y-axis direction in FIG. 3) than the cooling device 210. Therefore, not only the heat radiating pin 214, but also the driver circuit 300A is cooled.

As described above, in the exemplary embodiment, a sort of wind tunnel is formed in the case 100, the cooling device 210 of the light source unit 200A and the light source unit 200B and the driver circuits 300A and 300B are disposed along the Y-axis direction, and the air is flowed in a direction opposite to the Y-axis direction. Therefore, the cooling device 210 of the light source unit 200A and the light source unit 200B and the driver circuits 300A and 300B are simultaneously and efficiently cooled. Further, in the exemplary embodiment, an opening direction of the plurality of suction ports 102*a* is set to the Y-axis direction and an exhaust direction of the fans 400A and 400B is set to a direction opposite to the Z-axis direction, so that a light irradiating device 1 which is thin in the Y-axis direction is obtained.

Since a cooling capacity of the cooling device 210 is determined by a heat transporting amount of the heat pipe 212 and a heat radiating amount of the heat radiating pin 214, it is preferable that the number of heat pipes 212 and heat radiating pins 214 is large, from the point of view of the cooling capacity. However, the cooling capacity of the cooling device 210 is determined in accordance with a consumed cooling performance. However, when the number of heat pipes 212 is increased along the X-axis direction, the gap between adjacent heat pipes 212 is narrowed and the air flow is deteriorated. Therefore, in order to solve the above-mentioned problem, in the exemplary embodiment, as seen from the Z-axis direction, the arm units 212*b* of the eight heat pipes 212 are offset to be divided into two upper and lower stages to be alternately disposed (see FIG. 4). A gap is formed in the Y-axis direction between the arm units 212*b* of the heat pipe 212 which are adjacent to each other in the X-axis direction.

Even though the exemplary embodiment has been described above, the present invention is not limited to the above-described configuration and may be modified in various forms within a scope of a technical spirit of the present invention.

For example, in the exemplary embodiment, even though it is configured that the heat of the substrate 204 is received by the support plate 211 and the heat of the support plate 211 is radiated by the heat pipe 212 and the heat radiating pin 214, the support plate 211 is not necessarily required, but the substrate 204 and the heat pipe 212 may be directly bonded to each other.

Further, in the exemplary embodiment, it is described that a cross-section of the heat pipe 212 is a substantially circular shape, but the present invention is not limited to this configuration. For example, the cross-section of the heat pipe 212 may be a rectangle or a flat plate shape. Further, in the exemplary embodiment, even though it is described that an end of the heat pipe 212 is closely attached onto the support plate 211, for example, the end of the heat pipe 212 may be inserted in the support plate 211 to be thermally coupled thereto.

Further, even though it is described that the cooling device 210 of the exemplary embodiment has 70 sheets of heat radiating pins 214, the number of heat radiating pins 214 may be appropriately changed in accordance with a quantity of heat to be radiated.

Further, the light irradiating device 1 of the exemplary embodiment is a device which irradiates an ultraviolet ray, but the present invention is not limited to this configuration. Further, the present invention may be applied to a device which irradiates irradiating light (for example, visible light such as white light or infrared ray) of a different wavelength band.

Further, in the exemplary embodiment, even though a configuration in which twenty LED elements 206 are arranged on the substrate 204 of the light source unit 200A and the light source unit 200B has been suggested, the number of LED elements 206 may be appropriately changed in accordance with a specification. Further, N columns (N is 2 or larger integer) of LED elements 206 may be arranged along the Y-axis direction.

Further, in the exemplary embodiment, even though it is described that the fans 400A and 400B are exhaust fans which exhaust air in the case 100 to the outside, for example, the fans may be configured by suction fans. In this case, the suction port 102*a* (that is, an opening formed on the upper side panel 102) may be the exhaust port.

(Modification Embodiment of First Exemplary Embodiment)

Figure 6:
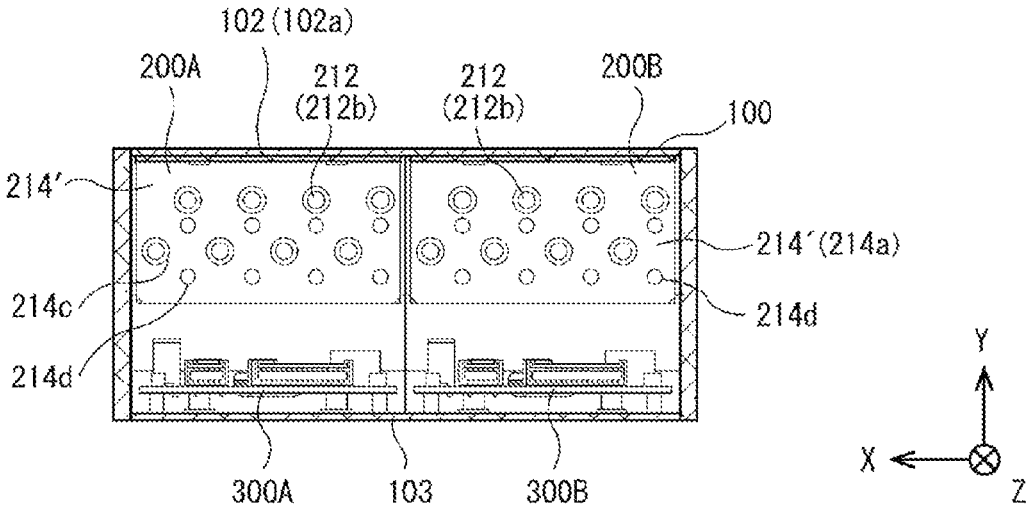
FIG. 6 is a view illustrating a modification embodiment of a light irradiating device according to a first exemplary embodiment of the present invention.

FIG. 6 is a view illustrating a modification embodiment of a heat radiating pin 214 provided in a light irradiating device 1 according to a first exemplary embodiment of the present invention. A heat radiating pin 214' of the modification embodiment includes a plurality of through holes 214*d*, which is different from the heat radiating pin 214 of the first exemplary embodiment.

As described above, when the plurality of through holes 214*d* is formed in the heat radiating pin 214', the air current generated in the case 100 also passes through the through hole 214*d*, so that an air quantity which passes between the heat radiating pins 214' is increased, thereby efficiently cooling the heat radiating pins 214'.

Second Exemplary Embodiment

Figure 7:
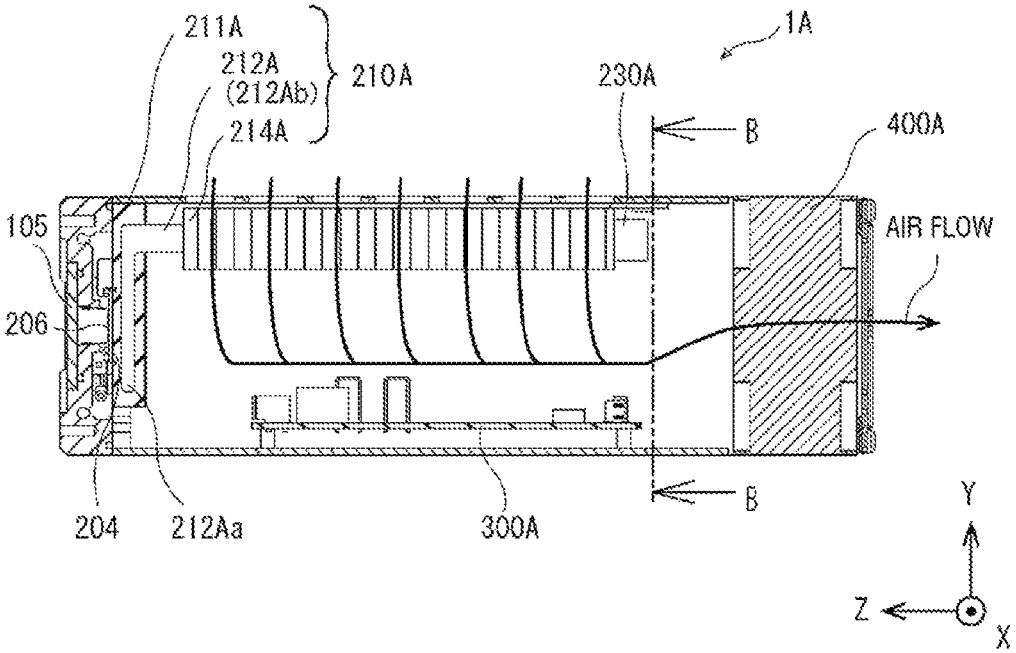
FIG. 7 is a cross-sectional view of an inner configuration of a light irradiating device according to a second exemplary embodiment of the present invention.
Figure 8:
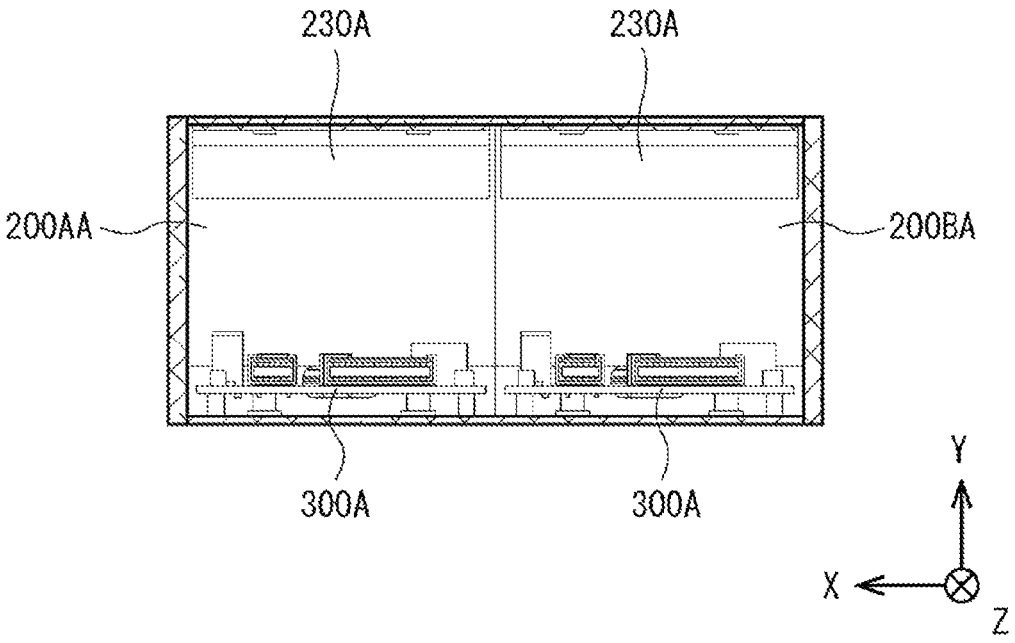
FIG. 8 is a cross-sectional view taken along the line B-B of FIG. 7.
Figure 9:
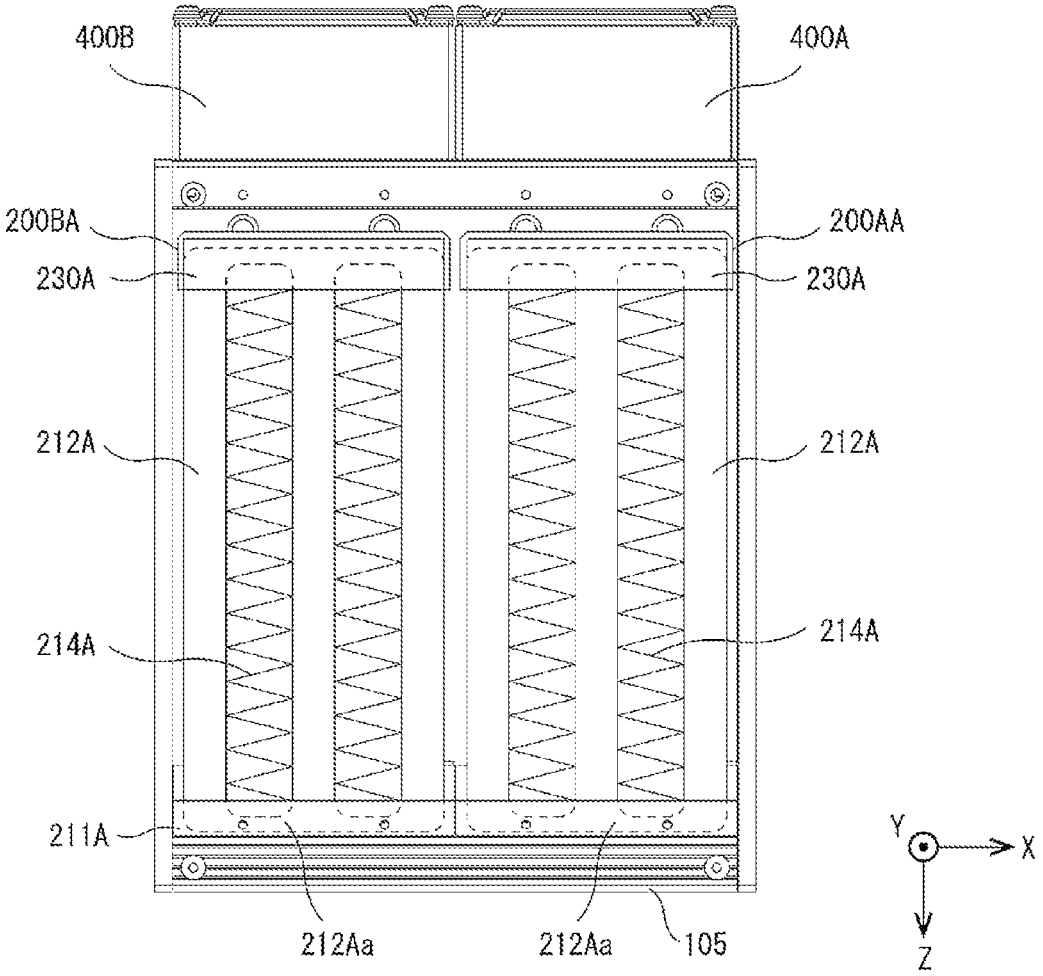
FIG. 9 is a view illustrating a shape in which an upper side panel is removed from a light irradiating device according to a second exemplary embodiment of the present invention.

FIGS. 7 to 9 are views explaining an inner configuration of a light irradiating device 1A according to a second exemplary embodiment of the present invention, FIG. 7 is a cross-sectional view of a Y-Z plane, FIG. 8 is a cross-sectional view taken along the line B-B of FIG. 7, and FIG. 9 is a top view when the upper side panel 102 of the light irradiating device 1A is removed.

As illustrated in FIGS. 7 to 9, in the light irradiating device 1A of the exemplary embodiment, a cooling device 210A of each of a light source unit 200AA and a light source unit 200BA includes three heat pipes 212A, a corrugated pin 214A formed between heat pipes 212A, and a connecting unit 230A which connects leading edges of the three heat pipes 212A and a folded part 212Aa of each heat pipe 212A is integrally formed in a support plate 211A, which is different from the light irradiating device 1 of the first exemplary embodiment.

Each heat pipe 212A has the same function as the heat pipe 212 of the first exemplary embodiment. As an operating fluid moves between the folded part 212Aa and the arm unit 212Ab of each heat pipe 212A, the heat of the support plate 211A moves to the arm unit 212Ab. Further, the heat moves from the arm unit 212Ab to the corrugated pin 214A which is formed in a zigzag shape and is radiated into the air from the corrugated pin 214A.

Further, as illustrated in FIG. 9, in the exemplary embodiment, the folded part 212Aa of each heat pipe 212A communicates in the support plate 211A in the X-axis direction and the leading edge of each heat pipe 212A communicates in the connecting unit 220A in the X-axis direction. Therefore, the operating fluid of each heat pipe 212A moves between the heat pipes 212A by means of the support plate 211A and the connecting unit 230A.

Similarly to the exemplary embodiment, when the folded part 212Aa of each heat pipe 212A and the support plate 211A are integrally formed, heat resistance between each heat pipe 212A and the support plate 211A may be lowered. Further, in the exemplary embodiment, the cooling device 210A is configured to include three independent heat pipes 212A and the connecting unit 230A which connects the leading edges of three heat pipes 212A. However, a circulating heat pipe in which the heat pipes 212A and the connecting units 230A are integrated may be applied. Further, three heat pipes 212A are not necessarily provided, for example, the cooling device 210A may bond the corrugated pin 214A to one heat pipe 212A by welding or soldering.

Third Exemplary Embodiment

Figure 10:
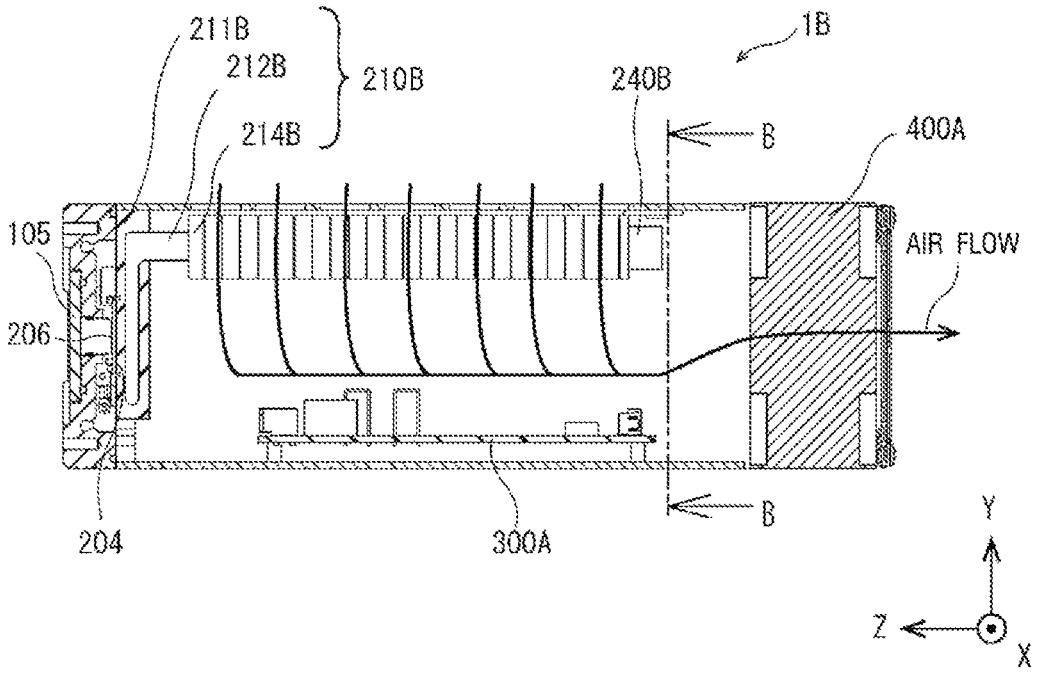
FIG. 10 is a cross-sectional view of an inner configuration of a light irradiating device according to a third exemplary embodiment of the present invention.
Figure 11:
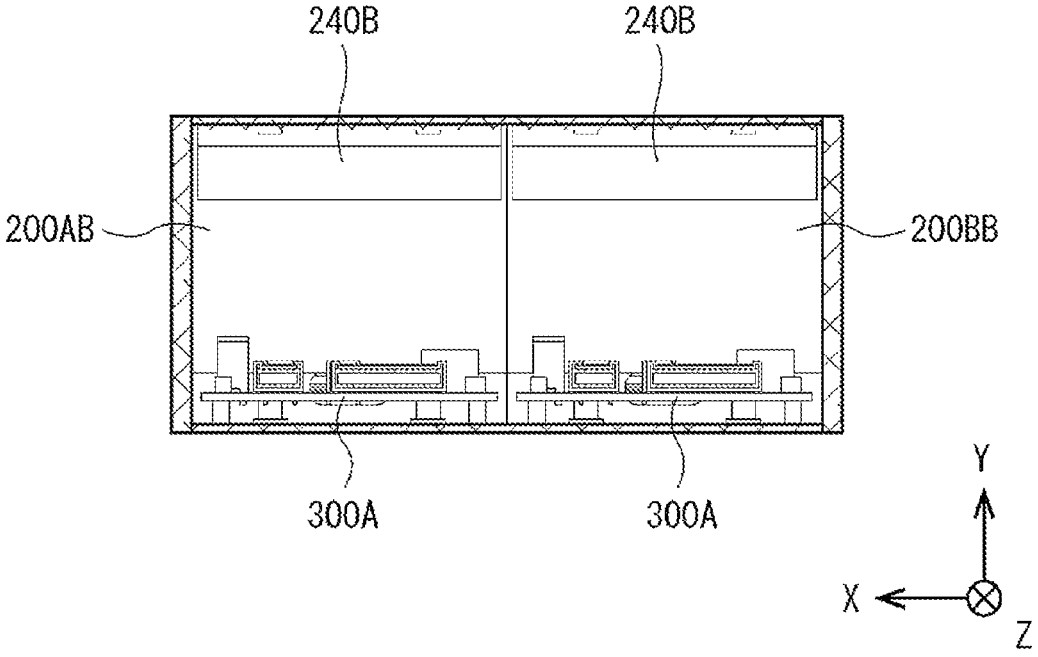
FIG. 11 is a cross-sectional view taken along the line B-B of FIG. 10.
Figure 12:
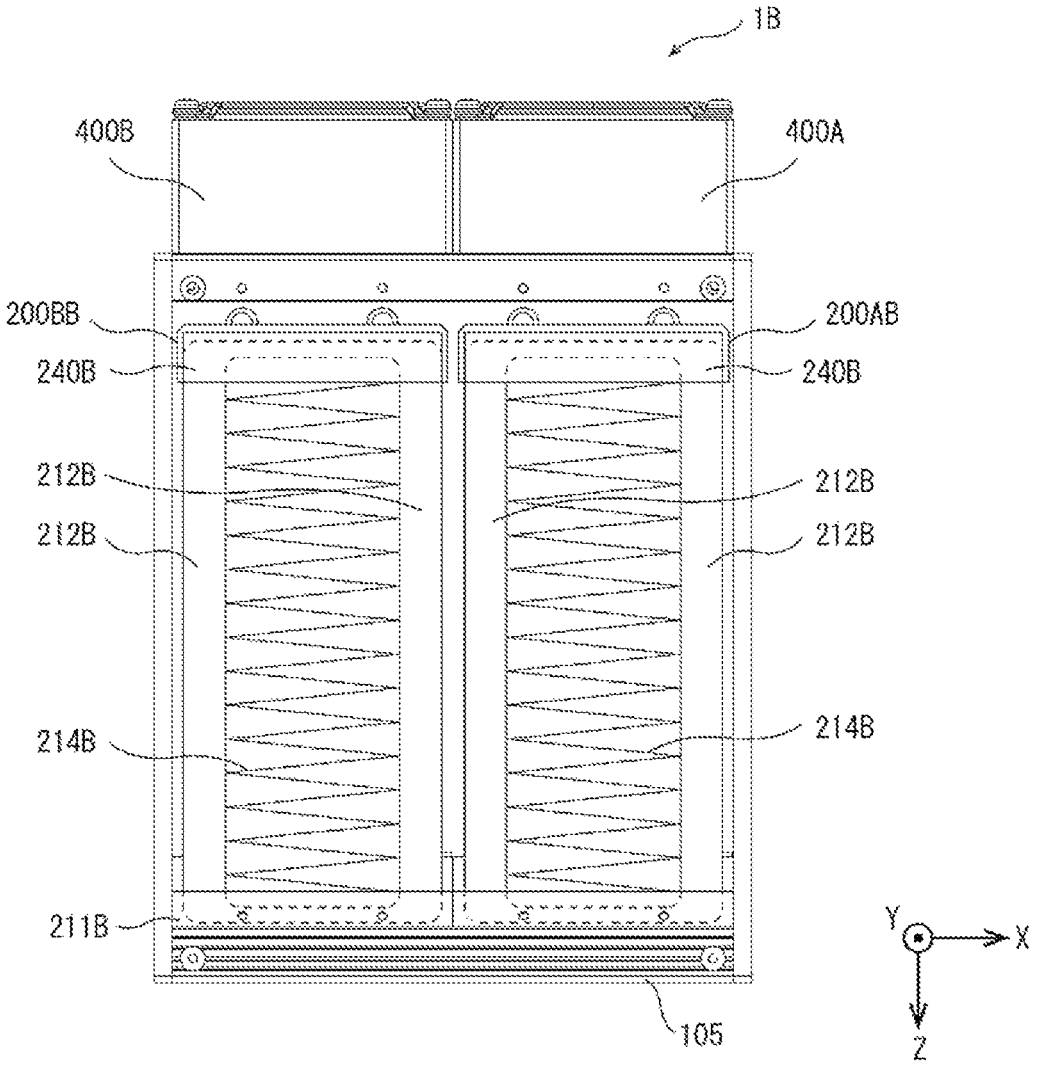
FIG. 12 is a view illustrating a shape in which an upper side panel is removed from a light irradiating device according to a third exemplary embodiment of the present invention.

FIGS. 10 to 12 are views explaining an inner configuration of a light irradiating device 1B according to a third exemplary embodiment of the present invention, FIG. 10 is a cross-sectional view of a Y-Z plane, FIG. 11 is a cross-sectional view taken along the line B-B of FIG. 10, and FIG. 12 is a top view when the upper side panel 102 of the light irradiating device 1B is removed.

As illustrated in FIGS. 10 to 12, in the light irradiating device 1B of the exemplary embodiment, a cooling device 210B of each of a light source unit 200AB and a light source unit 200BB includes a pair of coolant flow channels 212B, a corrugated pin 214B formed between the coolant flow channels 212B, and a pump unit 240B which is connected to leading edges of the pair of coolant flow channels 212B and circulates a coolant (for example, water or antifreeze liquid) which is filled in the pair of coolant flow channels 212B, which is different from the light irradiating device 1A of the second exemplary embodiment.

The coolant flow channels 212B are formed of metal pipes and the coolant therein moves to move the heat of the coolant to the corrugated pin 214B. That is, when the coolant in the coolant flow channel 212B circulates by the pump unit 240B, the heat of the support plate 211B moves to the coolant flow channels and also moves from the coolant flow channel 212B to the corrugated pin 214B which is formed in a zigzag shape.

As described above, the heat pipe 212A of the second exemplary embodiment is replaced by the coolant flow channel 212B in which the coolant is filled and the coolant in the coolant flow channel 212B may be circulated by the pump unit 240B. Further, in the exemplary embodiment, even though it is configured that the coolant in the coolant flow channel 212B is circulated by the pump unit 240B, a known boiling cooling technique may be applied. In this case, the pump unit 240B is not necessary.

Fourth Exemplary Embodiment

Figure 13:
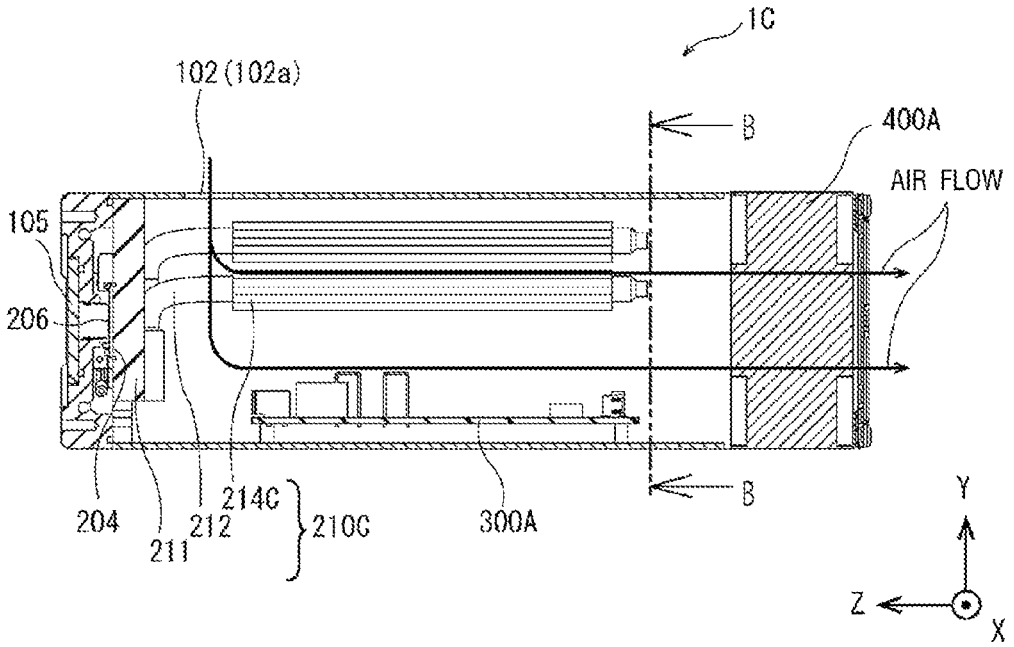
FIG. 13 is a cross-sectional view of an inner configuration of a light irradiating device according to a fourth exemplary embodiment of the present invention.
Figure 14:
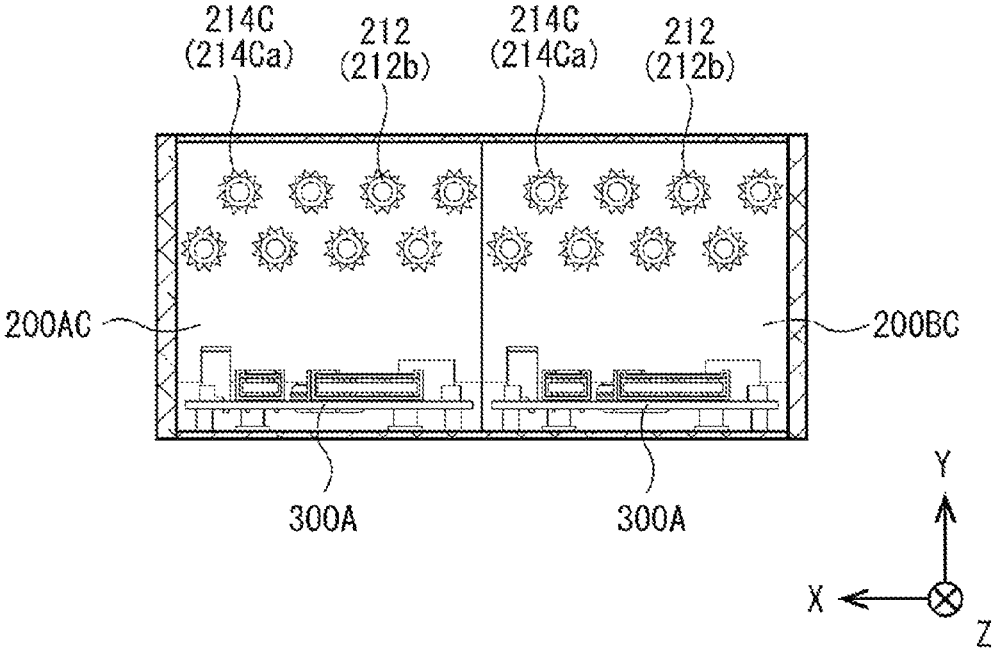
FIG. 14 is a cross-sectional view taken along the line B-B of FIG. 13.

FIGS. 13 and 14 are views explaining an inner configuration of a light irradiating device 1C according to a fourth exemplary embodiment of the present invention, FIG. 13 is a cross-sectional view of a Y-Z plane, and FIG. 14 is a cross-sectional view taken along the line B-B of FIG. 13. As illustrated in FIGS. 13 and 14, in the light irradiating device 1C of the exemplary embodiment, a cooling device 210C of each of a light source unit 200AC and a light source unit 200BC includes a substantially cylindrical heat radiating member 214C, instead of the rectangular panel shaped heat radiating pin 214, a suction port 102*a* is formed only on a substrate 204 of the upper side panel 102 of the case 100, and the heat radiating member 214C is not exposed from the suction port 102*a*, which is different from the light irradiating device 1 of the first exemplary embodiment.

The heat radiating member 214C is a metal member which is mounted (inserted) on the arm unit 212*b* of the heat pipe 212. A plurality of pins 214Ca (a radiation type pins) which radially protrudes as seen from the Z-axis direction is formed on an outer periphery of the heat radiating member 214C, and the heat of the arm unit 212*b* of each heat pipe 212 is discharged into the air by the plurality of pins 214Ca.

As described above, in the exemplary embodiment, since the heat radiating member 214C having the plurality of pins 214Ca is mounted in the arm unit 212*b* of each heat pipe 212, it is configured that the suction port 102*a* is formed only on the substrate 204 of the upper side panel 102 of the case 100 to efficiently flow the air on the surface of the pin 214Ca and the heat radiating member 214C is not exposed from the suction port 102*a*. That is, the suction port 102*a* is formed in the Z-axis direction further than the area facing the pin 214Ca of the upper side panel 102 so as not to expose the pin 214Ca from the suction port 102*a*. When the fans 400A and 400B rotate, outside air flows from the suction port 102*a* and passes between the pins 214Ca of the heat radiating members 214C of the light source unit 200A and the light source unit 200B, so that the heat of the pin 214Ca is efficiently radiated in the air. Further, as illustrated in FIG. 13, the air which flows from the suction port 102*a* touches the driver circuit 300A disposed at a lower side than the cooling device 210C (a side opposite to the Y-axis direction in FIG. 13). Therefore, similarly to the first exemplary embodiment, according to the configuration of the exemplary embodiment, not only the pin 214Ca, but also the driver circuit 300A is cooled.

Fifth Exemplary Embodiment

Figure 15A:
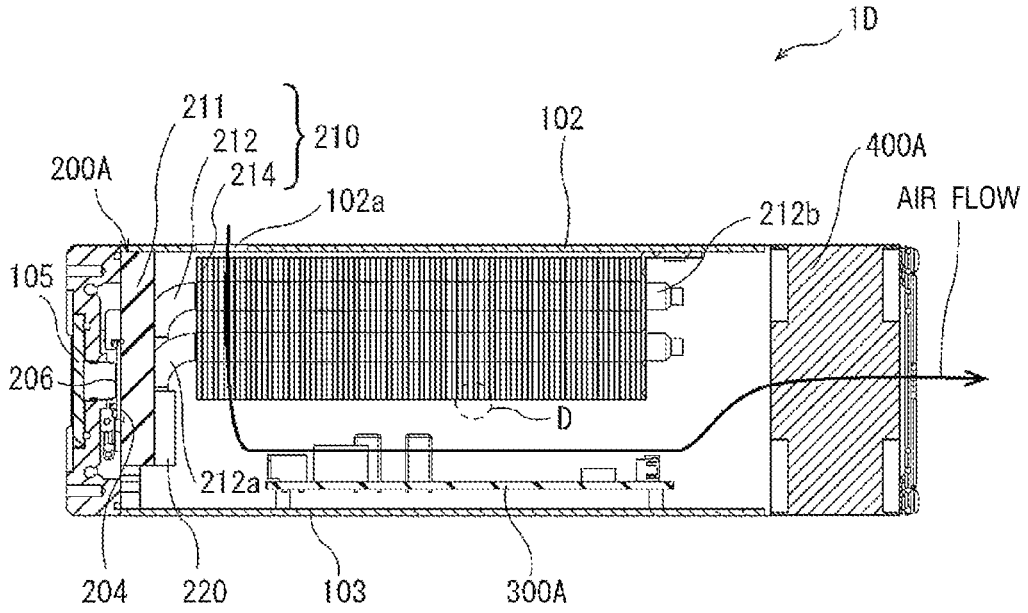
FIG. 15A is a cross-sectional view of an inner configuration of a light irradiating device according to a fifth exemplary embodiment of the present invention.
Figure 15B:
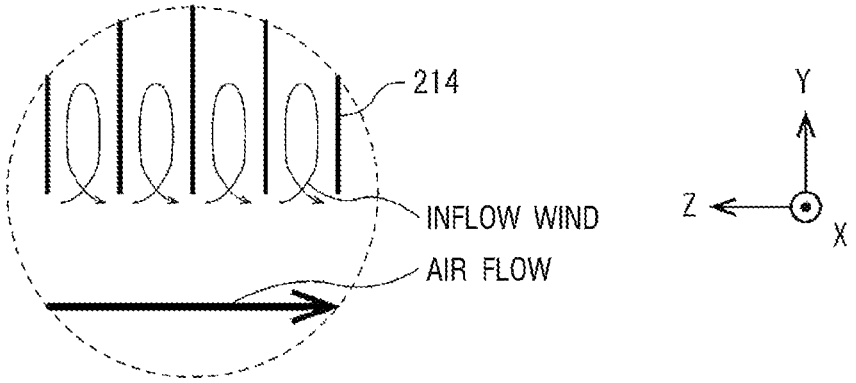
FIG. 15B is a view explaining an air flow in a part D of FIG. 15A.

FIG. 15 is a view explaining an inner configuration of a light irradiating device 1D according to a fifth exemplary embodiment of the present invention, FIG. 15A is a cross-sectional view of a Y-Z plane, and FIG. 15B is a view explaining an air flow in a part D of FIG. 15A. Further, FIG. 16 a perspective view of an exterior appearance of a light irradiating device 1D.

Figure 16:
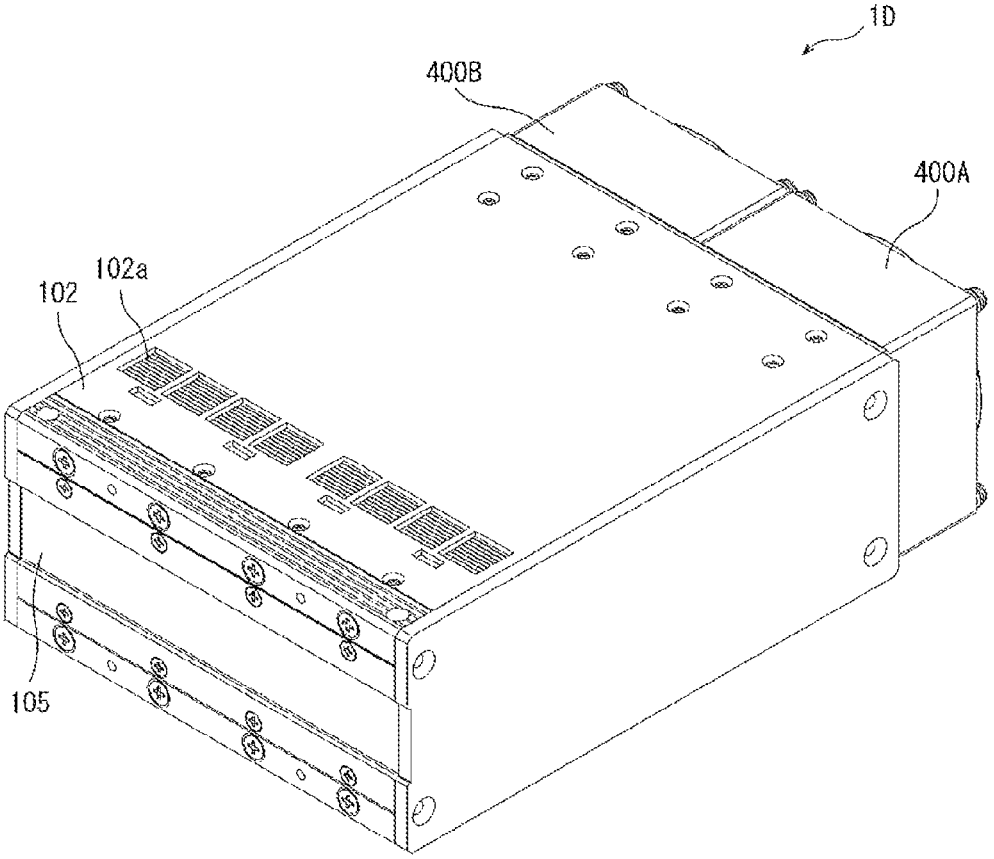
FIG. 16 is a perspective view of an exterior appearance of a light irradiating device according to a fifth exemplary embodiment of the present invention.

As illustrated in FIGS. 15 and 16, in the light irradiating device 1D of the exemplary embodiment, a suction port 102*a* is formed only on the substrate 204 of the upper side panel 102 of the case 100, which is different from the light irradiating device 1 according to the first exemplary embodiment. That is, the suction port 102*a* of the exemplary embodiment is formed in a part of an area facing the pin 214 of the upper side panel 102 so as to expose a part of the substrate 204 of the pin 214 from the suction port 102*a*.

When the fans 400A and 400B of the exemplary embodiment rotate, the outside air flows from the suction port 102*a* into the case 100. The air which flows from the suction port 102*a* touches the driver circuit 300A disposed at a lower side than the cooling device 210 (a side opposite to the Y-axis direction in FIG. 13). Therefore, similarly to the first exemplary embodiment, according to the configuration of the exemplary embodiment, not only the heat radiating pin 214, but also the driver circuit 300A is cooled.

Further, in the exemplary embodiment, the outside air does not flow from the heat radiating pin 214 which does not face the suction port 102*a*. However, as illustrated in FIG. 15B, when an air current in an opposing direction to the Z-axis direction is generated at a lower side of the heat radiating pin 214, an inflow wind is generated between the heat radiating pins 214, thereby cooling the heat radiating pins 214.

Figure 17:
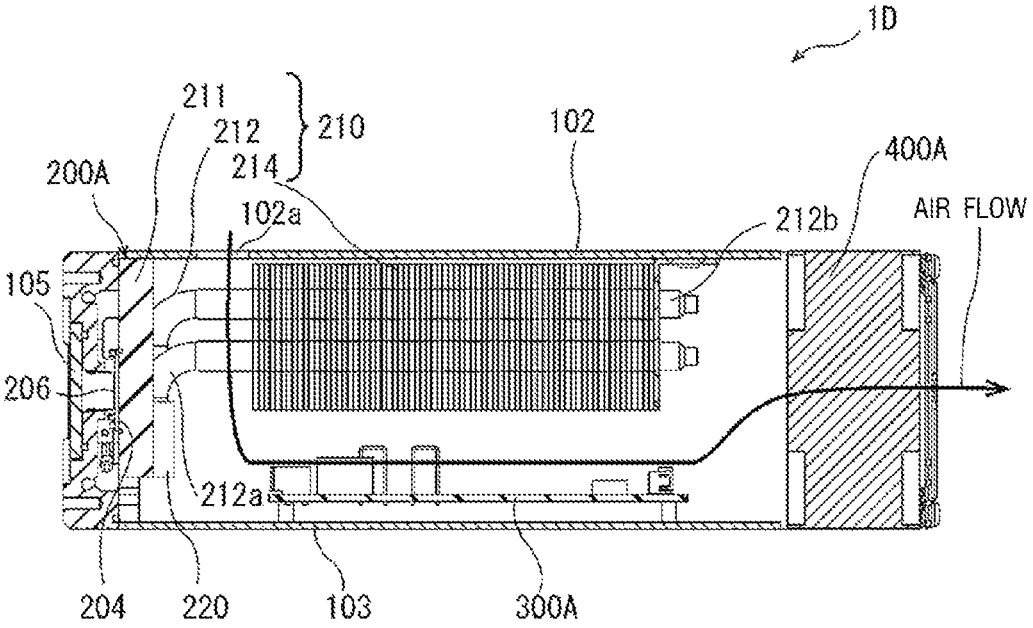
FIG. 17 is a cross-sectional view illustrating a modification embodiment a light irradiating device according to a fifth exemplary embodiment of the present invention.

Further, as a modification embodiment of the exemplary embodiment, as illustrated in FIG. 17, it may be configured such that the heat radiating pin 214 is not exposed through the suction port 102*a*. That is, similarly to the fourth exemplary embodiment, the suction port 102*a* is formed at the downstream of the Z-axis direction further than the area facing the pin 214 of the upper side panel 102 so as not to expose the pin 214 from the suction port 102*a*. Further, in this case, since the heat radiating pin 214 does not face the suction port 102*a*, the outside air does not flow between the heat radiating pins 214. However, similarly to the exemplary embodiment (fifth exemplary embodiment), the heat radiating pin 214 is cooled by the inflow wind generated between the heat radiating pins 214

Sixth Exemplary Embodiment

Figure 18A:
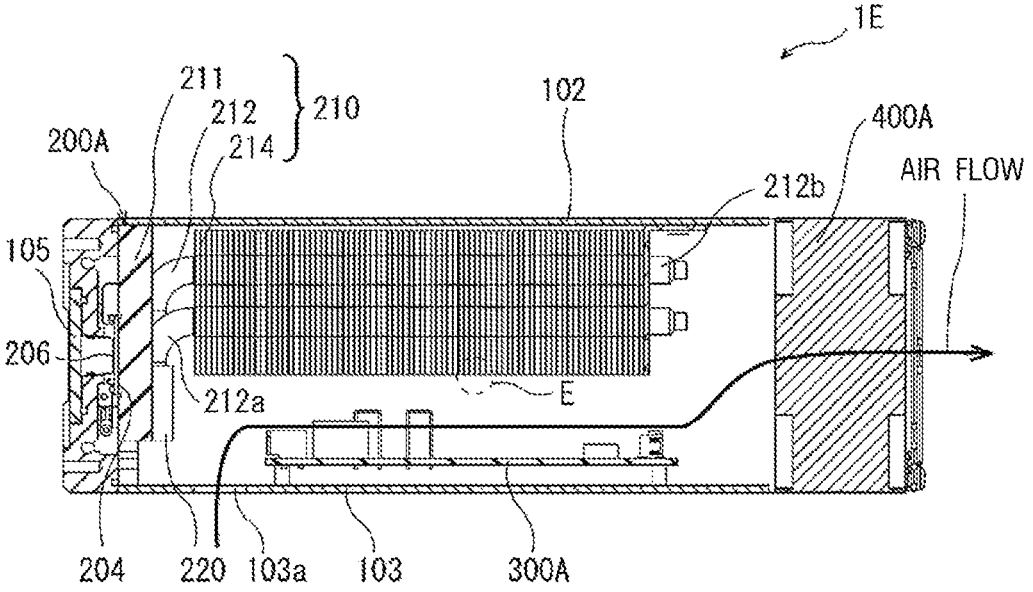
FIG. 18A is a cross-sectional view of an inner configuration of a light irradiating device according to a sixth exemplary embodiment of the present invention.
Figure 18B:
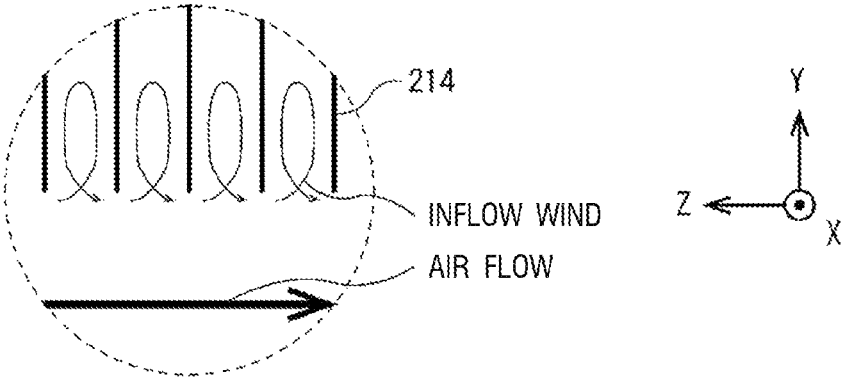
FIG. 18B is a view explaining an air flow in a part E of FIG. 18A.

FIG. 18 is a view explaining an inner configuration of a light irradiating device 1E according to a sixth exemplary embodiment of the present invention, FIG. 18A is a cross-sectional view of a Y-Z plane, and FIG. 18B is a view explaining an air flow in a part E of FIG. 18A.

As illustrated in FIGS. 18 and 16, in the light irradiating device 1E of the exemplary embodiment, a suction port 103*a* is formed only on the substrate 204 of a lower side panel 103 of the case 100, which is different from the light irradiating device 1D according to the fifth exemplary embodiment.

In the configuration of the exemplary embodiment, when the fans 400A and 400B rotate, the outside air flows from the suction port 103*a* into the case 100. The air flowing from the suction port 103*a* flows in the case in a direction opposite to the Z-axis direction to be exhausted to the outside. Also in the configuration according to the exemplary embodiment, the air which flows from the suction port 103*a* touches the driver circuit 300A disposed at a lower side than the cooling device 210 (a side opposite to the Y-axis direction in FIG. 18). Therefore, similarly to the fifth exemplary embodiment, according to the configuration of the exemplary embodiment, not only the heat radiating pin 214, but also the driver circuit 300A is cooled.

Further, in the exemplary embodiment, the heat radiating pin 214 does not face the suction port 103*a*, so that the outside air does not flow between the heat radiating pins 214. However, similarly to the fifth and sixth exemplary embodiments, as illustrated in FIG. 18B, the flowed air is generated between the heat radiating pins 214, thereby cooling the heat radiating pins 214.

Seventh Exemplary Embodiment

Figure 19A:
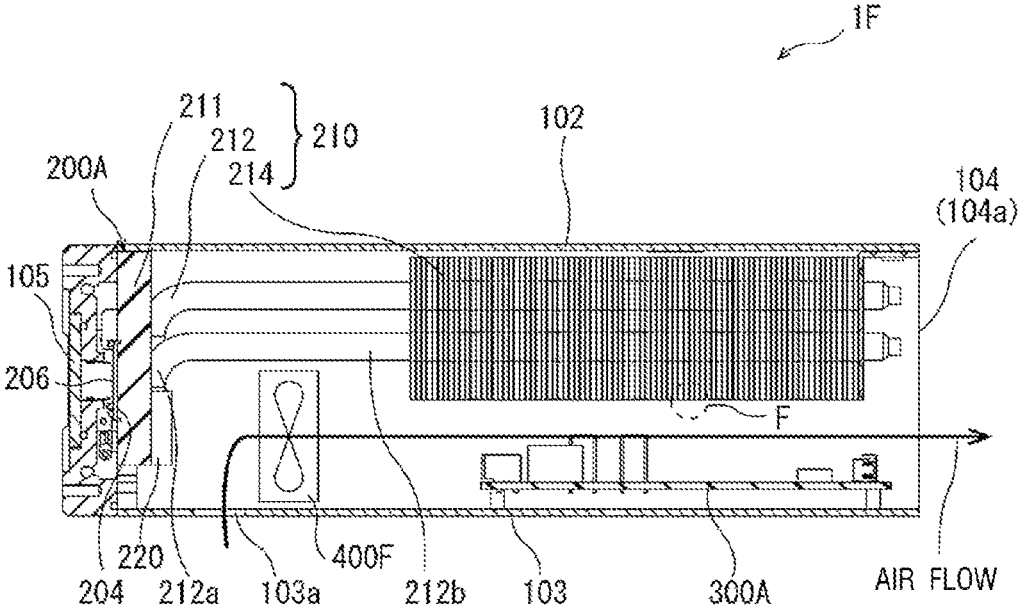
FIG. 19A is a cross-sectional view of an inner configuration of a light irradiating device according to a seventh exemplary embodiment of the present invention.
Figure 19B:
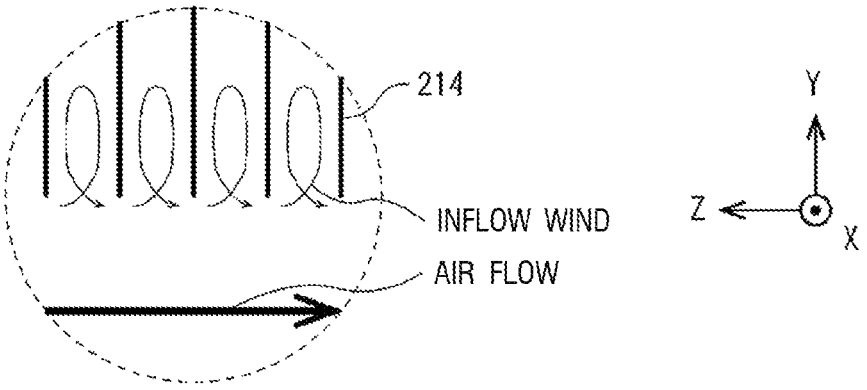
FIG. 19B is a view explaining an air flow in a part F of FIG. 19A.

FIG. 19 is a view explaining an inner configuration of a light irradiating device 1F according to a fifth embodiment of the present invention, FIG. 19A is a cross-sectional view of a Y-Z plane, and FIG. 19B is a view explaining an air flow in a part F of FIG. 19A.

As illustrated in FIG. 19, in the light irradiating device 1F of the exemplary embodiment, a fan 400F is disposed between the suction 103*a* and the heat radiating pin 214, which is different from the light irradiating device 1F according to the sixth exemplary embodiment.

In the configuration of the exemplary embodiment, when the fan 400F rotates, the outside air flows from the suction port 103*a* into the case 100. The air flowing from the suction port 103*a* flows in the case in a direction opposite to the Z-axis direction to be exhausted from the exhaust port 104*a* formed on the rear side panel 104 to the outside. Also in the configuration according to the exemplary embodiment, the air which flows from the suction port 103*a* touches the driver circuit 300A disposed at a side lower than the cooling device 210C (a direction opposite to the Y-axis direction in FIG. 13). Therefore, similarly to the sixth exemplary embodiment, according to the configuration of the exemplary embodiment, the driver circuit 300A is cooled.

However, as illustrated in FIG. 19B, also in the exemplary embodiment, similarly to the fifth to seventh exemplary embodiments, when an air current in an opposing direction to the Z-axis direction is generated at a lower side of the heat radiating pin 214, an inflow wind is generated between the heat radiating pins 214, thereby cooling the heat radiating pins 214.

The disclosed exemplary embodiments are illustrative at everything but are not restrictive. The scope of the present invention is represented not by the above description, but by claims and it is intended that all changes are included within an equivalent meaning and range with a scope of the claims.

EXPLANATION OF REFERENCE NUMERALS AND SYMBOLS

1, 1A, 1B, 1C, 1D, 1E, 1F Light radiating device
100 Case
102 Upper side panel
102*a* Suction port
103 Lower side panel
103*a* Suction port
104 Rear side panel
104*a* Exhaust port
105 Window
200A, 200B, 200AA, 200BA, 200AB, 200BB, 200AC, 200BC Light source unit
204 Substrate
206 LED element
210 Cooling device
211, 211A Support plate
212, 212A Heat pipe
212B Coolant flow channel
212*a*, 212Aa Curved part
212*b*, 212Ab Arm unit
214 Heat radiating pin
214A, 214B Corrugated pin
214C Heat radiating member
214Ca Pin
214*a* Flat part
214*b* Folded part
214*c* Through hole
220 Fixture
230A Connecting unit
240B Pump unit
300A, 300B Driver circuit
400A, 400B, 400F Fan

What is claimed is:

1. A light irradiating device which extends on an irradiating surface in a first direction and irradiates linear light having a predetermined line width in a second direction intersecting the first direction, the light irradiating device comprising:

a substrate which is substantially parallel to the first direction and the second direction;

a plurality of light emitting diode (LED) light sources which is disposed on a surface of the substrate with predetermined intervals along the first direction and emits light in a third direction intersecting the surface of the substrate;

a cooling unit which includes a heat transporting unit which is at least partially in contact with a rear surface of the substrate, extends in an opposite direction to the third direction from the substrate, and transports heat generated from the LED light source to the opposite direction to the third direction, and a plurality of heat radiating pins which is mounted on the heat transporting unit to radiate heat of the heat transporting unit into the air;

an LED driver circuit which drives the plurality of LED light sources;

a housing which has one surface of the second direction and the other surface opposite to the one surface, an opening sucking and exhausting external air on the one surface, accommodates the cooling unit and the LED driver circuit, and forms a wind tunnel in an area where the cooling unit and the LED driver circuit are disposed; and a fan which is provided at an opposite side to the third direction of the cooling unit to guide the external air to the wind tunnel and generate an air current in the wind tunnel, wherein the cooling unit is disposed along the one surface of the housing and the LED driver circuit is disposed along the other surface of the housing.

2. The light irradiating device of claim 1, wherein the opening is formed in an area facing the plurality of heat radiating pins in the one direction of the housing so as to expose the plurality of heat radiating pins from the opening.

3. The light irradiating device of claim 1, wherein the opening is formed in a part of an area facing the plurality of heat radiating pins in the one direction of the housing so as to expose a part of the plurality of heat radiating pins at the substrate side from the opening.

4. The light irradiating device of claim 1, wherein the opening is formed more downstream of the third direction than an area facing the plurality of heat radiating pins in the one direction of the housing so as not to expose the plurality of heat radiating pins from the opening.

5. The light irradiating device of claim 1, wherein the plurality of heat radiating pins is a parallel flat type pin which is disposed to be substantially parallel to the substrate so that the heat transporting unit passes therethrough, a radiation type pin which radially protrudes from an outer periphery of a tubular heat radiating member into which the heat transporting unit is inserted, or a corrugated pin which is provided in the heat transporting unit.

6. The light irradiating device of claim 5, wherein the plurality of heat radiating pins is the parallel flat type pins, and the parallel flat type pin has a plurality of through holes through which the air current passes.

7. The light irradiating device of claim 1, wherein the outside air flows between the plurality of heat radiating pins from the opening and flows along the LED driver circuit to be exhausted from the fan.

8. The light irradiating device of claims 1, wherein the outside air flows from the fan to flow along the LED driver circuit and passes between the plurality of heat radiating pins to be exhausted from the opening.

9. The light irradiating device of claim 1, wherein the heat transporting unit is at least one heat pipe or at least one coolant flow channel in which coolant is included.

10. The light irradiating device of claim 9, wherein the heat transporting unit is a plurality of heat pipes, and the heat pipes are offset in the second direction with respect to a heat pipe adjacent thereto along the first direction.

11. The light irradiating device of claim 1, wherein when a length of the cooling unit in the second direction is L1 and a length of the heat radiating pin in the second direction is L2, the following conditional expression 1 is satisfied.

$$L2<L1 \quad (1)$$

12. The light irradiating device of claim 1, wherein the light is light in an ultraviolet wavelength band.

13. A light irradiating device which extends on an irradiating surface in a first direction and irradiates linear light having a predetermined line width in a second direction intersecting the first direction, the light irradiating device comprising:

a substrate which is substantially parallel to the first direction and the second direction;

a plurality of light emitting diode (LED) light sources which is disposed on a surface of the substrate with predetermined intervals along the first direction and emits light in a third direction intersecting the surface of the substrate;

a cooling unit which includes a heat transporting unit which at least partially abuts against a rear surface of the substrate, extends in an opposite direction to the third direction from the substrate, and transports heat generated from the LED light source to the opposite direction to the third direction, and a plurality of heat radiating pins which is mounted on the heat transporting unit to radiate heat of the heat transporting unit into the air;

an LED driver circuit which drives the plurality of LED light sources;

a housing which has an opening sucking and exhausting external air on one surface of the second direction, accommodates the cooling unit and the LED driver circuit, and forms a wind tunnel in an area where the cooling unit and the LED driver circuit are disposed; and a fan which is provided between the opening and the heat radiating pin in the third direction to guide the external air to the wind tunnel and generate an air current in the wind tunnel, wherein the LED driver circuit is disposed along the one direction and the cooling unit is disposed along the other surface which is opposite to the one surface.

* * * * *